US008960459B2

(12) United States Patent
Givens

(10) Patent No.: US 8,960,459 B2
(45) Date of Patent: Feb. 24, 2015

(54) SLANT-TRUSS CRANE RAIL

(76) Inventor: Ray Givens, London (CA)

( * ) Notice: Subject to any disclaimer, the term of this patent is extended or adjusted under 35 U.S.C. 154(b) by 842 days.

(21) Appl. No.: 13/012,669

(22) Filed: Jan. 24, 2011

(65) Prior Publication Data

US 2011/0180507 A1 Jul. 28, 2011

Related U.S. Application Data

(60) Provisional application No. 61/297,476, filed on Jan. 22, 2010.

(51) Int. Cl.

| | |
|---|---|
| ***B66C 19/00*** | (2006.01) |
| ***B66C 7/02*** | (2006.01) |
| ***B66C 5/02*** | (2006.01) |
| ***B66C 5/10*** | (2006.01) |
| ***B66C 7/04*** | (2006.01) |

(52) U.S. Cl.

CPC ... *B66C 7/02* (2013.01); *B66C 5/02* (2013.01); *B66C 5/10* (2013.01); *B66C 7/04* (2013.01)

USPC ..... 212/73; 212/74; 212/328; 52/653.2

(58) Field of Classification Search

CPC ..... B66C 5/02; B66C 6/00; B66C 17/00; E04B 1/24; E04B 2001/2451

USPC ..... 212/72–74, 122, 328, 336; 52/653.2

See application file for complete search history.

(56) References Cited

U.S. PATENT DOCUMENTS 278,774 A * 6/1883 Capen ..... 212/312
779,493 A * 1/1905 MoMyler ..... 414/21
945,751 A * 1/1910 Butler et al. ..... 104/95
1,204,470 A * 11/1916 Miller ..... 254/342
1,296,755 A * 3/1919 Buckley ..... 105/163.1

(Continued)

OTHER PUBLICATIONS

Unified Industries, Diagram, Undated.

(Continued)

*Primary Examiner* — Emmanuel M Marcelo
*Assistant Examiner* — Michael Gallion
(74) *Attorney, Agent, or Firm* — Katten Muchin Rosenman LLP

(57) ABSTRACT

In one aspect, the invention is directed to an overhead crane with one or more bridge rails, that incorporates a reinforcement truss into its one or more bridge rails so as to reduce the overall mass of the one or more bridge rails. This facilitates movement of a load carried by the bridge by an operator to a destination point, particularly in embodiments wherein the one or more bridge rails do not have any bridge drive motors thereon. Reducing the mass of the bridge can increase the amount of lifted load that can comfortably be maneuvered by an operator, particularly when the bridge is manually moved along the runway. Additionally, reducing the mass of the bridge reduces the momentum associated with the bridge, which can increase the amount of control that the operator has when it is desired to stop the bridge when the load has been maneuvered to its desired destination point. The second reinforcement members may have first and second ends that are inserted into receiving apertures in the first reinforcement member and in a bracket that mounts to the bridge rail respectively. In embodiments wherein the bridge includes two rails and is capable of supporting a load in such a way as to generate a downward force that is offset from the bridge axis, the second reinforcement members may be connected to the first reinforcement member and to brackets in such a way as to prevent the withdrawal of the second reinforcement members from the receiving apertures.

16 Claims, 14 Drawing Sheets

(56) References Cited

U.S. PATENT DOCUMENTS

| | | | | | |
|---|---|---|---|---|---|
| 1,515,023 | A | * | 11/1924 | Fitch | 104/126 |
| 1,858,183 | A | * | 5/1932 | Bridges | 294/63.1 |
| 3,062,340 | A | * | 11/1962 | Hunnebeck | 52/646 |
| 4,202,529 | A | * | 5/1980 | Fitting | 254/89 H |
| 4,502,527 | A | * | 3/1985 | Brewer | 164/418 |
| 4,569,453 | A | * | 2/1986 | Oustad | 212/299 |
| 4,730,743 | A | * | 3/1988 | Rosman | 212/312 |
| 4,924,164 | A | * | 5/1990 | Riley | 318/587 |
| 5,022,542 | A | * | 6/1991 | Beier | 212/325 |
| 5,230,197 | A | * | 7/1993 | Hart | 52/653.2 |
| 5,337,908 | A | * | 8/1994 | Beck, Jr. | 212/312 |
| 5,385,249 | A | * | 1/1995 | Long, Jr. | 212/324 |
| 5,443,151 | A | * | 8/1995 | Taylor | 198/860.1 |
| 5,526,614 | A | * | 6/1996 | Huang | 52/13 |
| 5,669,518 | A | * | 9/1997 | Kundel | 212/315 |
| 5,694,857 | A | | 12/1997 | Taylor | |
| 5,921,415 | A | * | 7/1999 | Markelz | 212/294 |
| 6,739,096 | B2 | * | 5/2004 | Feldpausch et al. | 52/36.1 |
| 7,048,491 | B2 | * | 5/2006 | Windbergs | 414/542 |
| 7,850,026 | B2 | * | 12/2010 | McKay | 212/315 |
| 8,678,209 | B2 | * | 3/2014 | Chernyak | 212/324 |
| 2002/0084238 | A1 | * | 7/2002 | Zingerman | 212/179 |
| 2004/0238473 | A1 | * | 12/2004 | McKay | 212/315 |
| 2012/0005980 | A1 | * | 1/2012 | Kundel et al. | 52/651.05 |
| 2013/0112645 | A1 | * | 5/2013 | Laliberte et al. | 212/312 |

OTHER PUBLICATIONS

Gorbel Inc., Photograph, Undated.

* cited by examiner

SLANT-TRUSS CRANE RAIL

FIELD OF THE INVENTION

The present invention relates to overhead cranes for use in industrial plants, and more particularly to an overhead crane that is configured to lift a load using motorized means, but wherein an operator manually pulls or pushes the lifted load to its destination.

BACKGROUND OF THE INVENTION

Overhead cranes typically include a pair of runways, which may be mounted fixedly to the roof joists of an industrial plant, a bridge that includes one or more bridge rails which have rollers at their ends for rolling along the runway rails, and a trolley which has rollers thereon for rolling along the one or more bridge rails. A hoist or some other lifting device is provided on the trolley for lifting a load.

For cranes having capacities of more than 4000 lb, I-Beam crane rails are typically used for the one or more bridge rails and for the runways. For cranes having capacities of less 4000 lb, enclosed track crane rails, such as the crane rail shown at 100 in FIG. 1 are typically used.

A particular category of cranes are referred to as 'light' cranes, and typically have a capacity of about 2000 lb or less. Light cranes typically do not have tractor drives on the bridge and trolley, which means that the load, once lifted off the plant floor, is moved around manually by the crane operator.

For such cranes, the weight of the bridge rails directly impacts the effort that the operator is required to exert when moving the lifted load to its destination. It is thus generally desirable to reduce the weight of the bridge rails. By reducing their weight, the effort required to move a given size of lifted load can be reduced.

A typical enclosed bridge rail is shown in FIG. 1. One method that has been used to reduce the weight of the bridge rail is to manufacture the bridge rail out of aluminum.

It would be desirable to find other ways of reducing the weight of the bridge rail particularly for light cranes that lack tractor drives for moving the bridge on the runways.

SUMMARY OF THE INVENTION

In a first aspect, the invention is directed to an overhead crane with one or more bridge rails, that incorporates a reinforcement truss into its one or more bridge rails so as to reduce the overall mass of the one or more bridge rails. This facilitates movement of a load carried by the bridge by an operator to a destination point, particularly in embodiments wherein the one or more bridge rails do not have any bridge drive motors thereon. Reducing the mass of the bridge can increase the amount of lifted load that can comfortably be maneuvered by an operator, particularly when the bridge is manually moved along the runway. Additionally, reducing the mass of the bridge reduces the momentum associated with the bridge, which can increase the amount of control that the operator has when it is desired to stop the bridge when the load has been maneuvered to its desired destination point. The second reinforcement members may have first and second ends that are inserted into receiving apertures in the first reinforcement member and in a bracket that mounts to the bridge rail respectively. In embodiments wherein the bridge includes two rails and is capable of supporting a load in such a way as to generate a downward force that is offset from the bridge axis, the second reinforcement members may be connected to the first reinforcement member and to brackets in such a way as to prevent the withdrawal of the second reinforcement members from the receiving apertures.

In another aspect, the invention is directed to a retrofit kit that permits the reinforcing structure described above to be easily retrofitted to existing bridge rails without the need for welding and without the need to install an inordinate quantity of fasteners.

BRIEF DESCRIPTION OF THE DRAWINGS

The present invention will now be described by way of example only with reference to the attached drawings, in which:

FIG. 9 is a magnified perspective view of the mounting of a second reinforcement member to the bridge rail shown in FIG. 2;

DETAILED DESCRIPTION OF THE INVENTION

Figure 2:
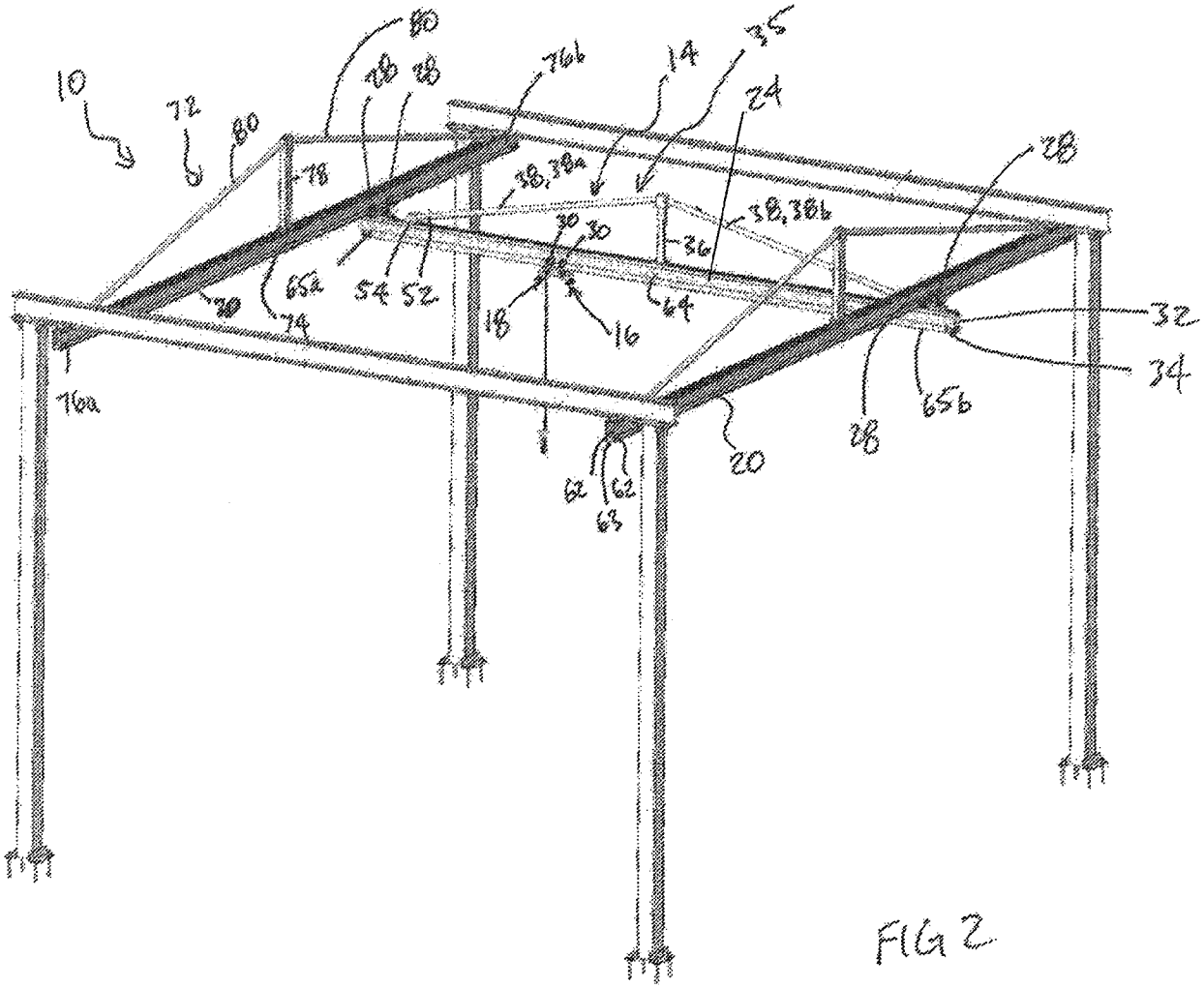
FIG. 2 is a perspective view of an overhead crane including a bridge in accordance with an embodiment of the present invention.

Reference is made to FIG. 2, which shows an overhead crane 10 in accordance with an embodiment of the present invention. The overhead crane 10 includes a pair of runway rails 20, a bridge 14, a trolley 16 and a lifting device 18, such as a hoist. The runway rails 20 extend parallel to a generally horizontal runway axis. The bridge 14 is made up of a single bridge rail 24 that extends parallel along a generally horizontal bridge axis that is perpendicular to the runway axis. The bridge rail 24 is rollably supported on the runway rails 20 at each end by bridge wheels 28. The bridge 14 may be manually rollable along the runway rails 20 through the bridge wheels 28. Alternatively a bridge drive motor may be provided (not shown) to drive the bridge 14 on the runway rails 20. The trolley 16 is rollably supported on the bridge rail 24 by means of trolley wheels 30. The trolley 16 may be manually rollable along the bridge rail 24. Alternatively a trolley drive motor (not shown) may be provided to drive the trolley 16 along the bridge rail 24.

Figure 11:
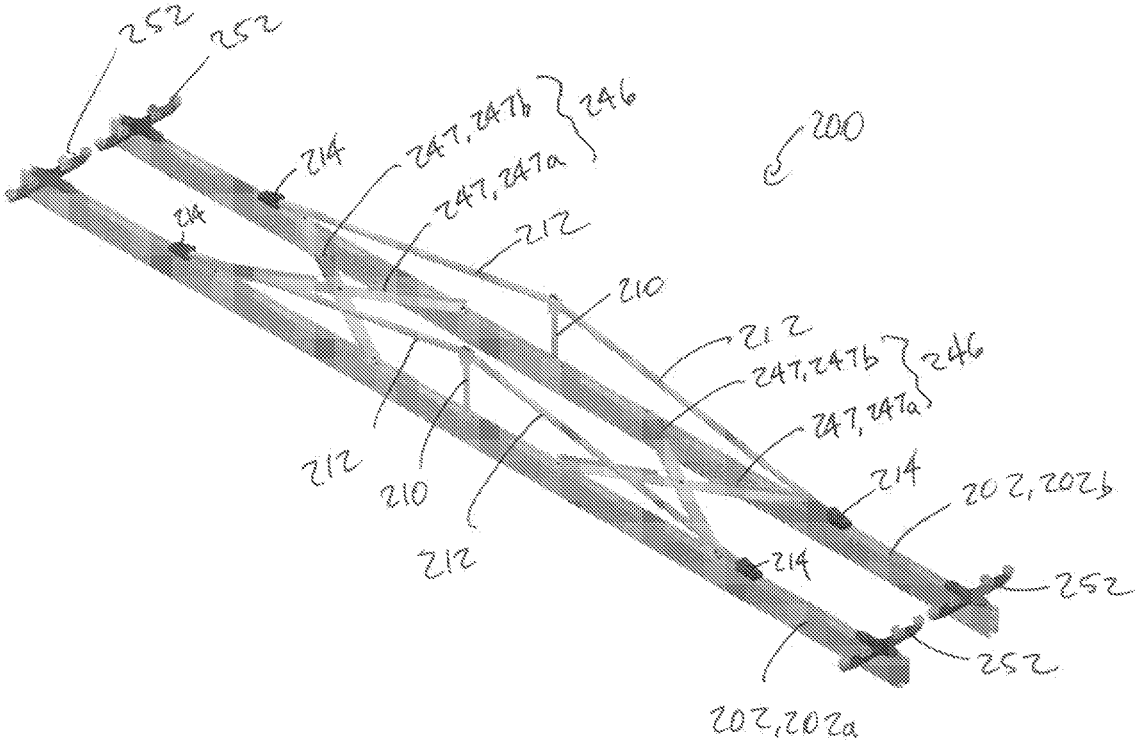
FIG. 11 is a perspective view of a double rail bridge that may be used with the overhead crane system shown in FIG. 2.

The bridge 14 shown in FIG. 2 has a single bridge rail 24. It will be noted that, in an alternative embodiment the bridge 14 could be provided with two or more bridge rails 24 (as shown in FIG. 11), and with a trolley that has wheels that roll along each bridge rail.

Figure 4:
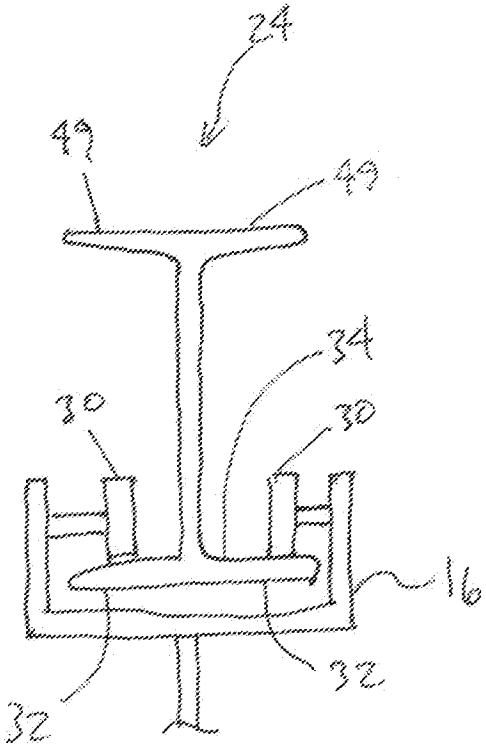
FIG. 4 is a magnified end view of an alternative bridge rail that could alternatively be part of the bridge shown in FIG. 2.
Figure 3:
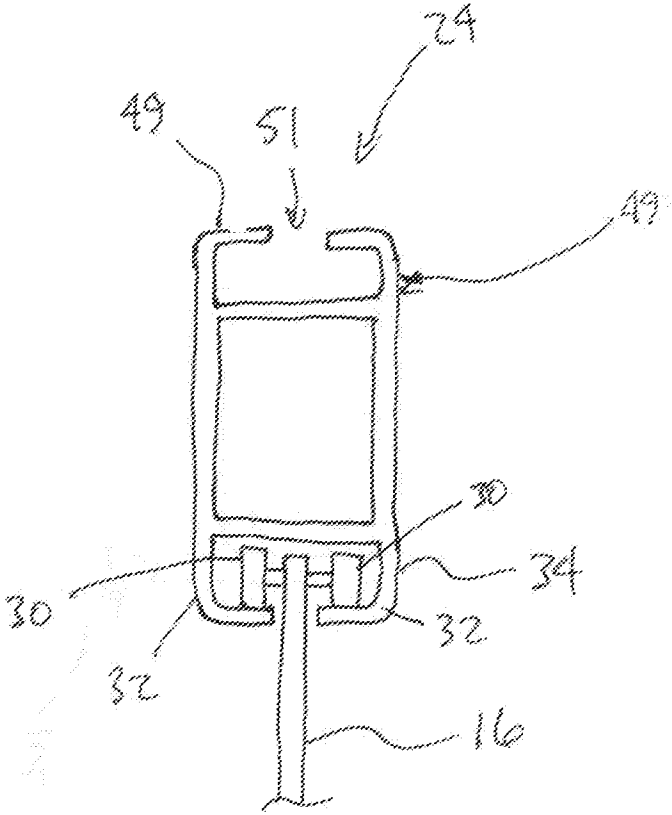
FIG. 3 is a magnified end view of a bridge rail that is part of the bridge shown in FIG. 2.
Figures 5, 6, 7:
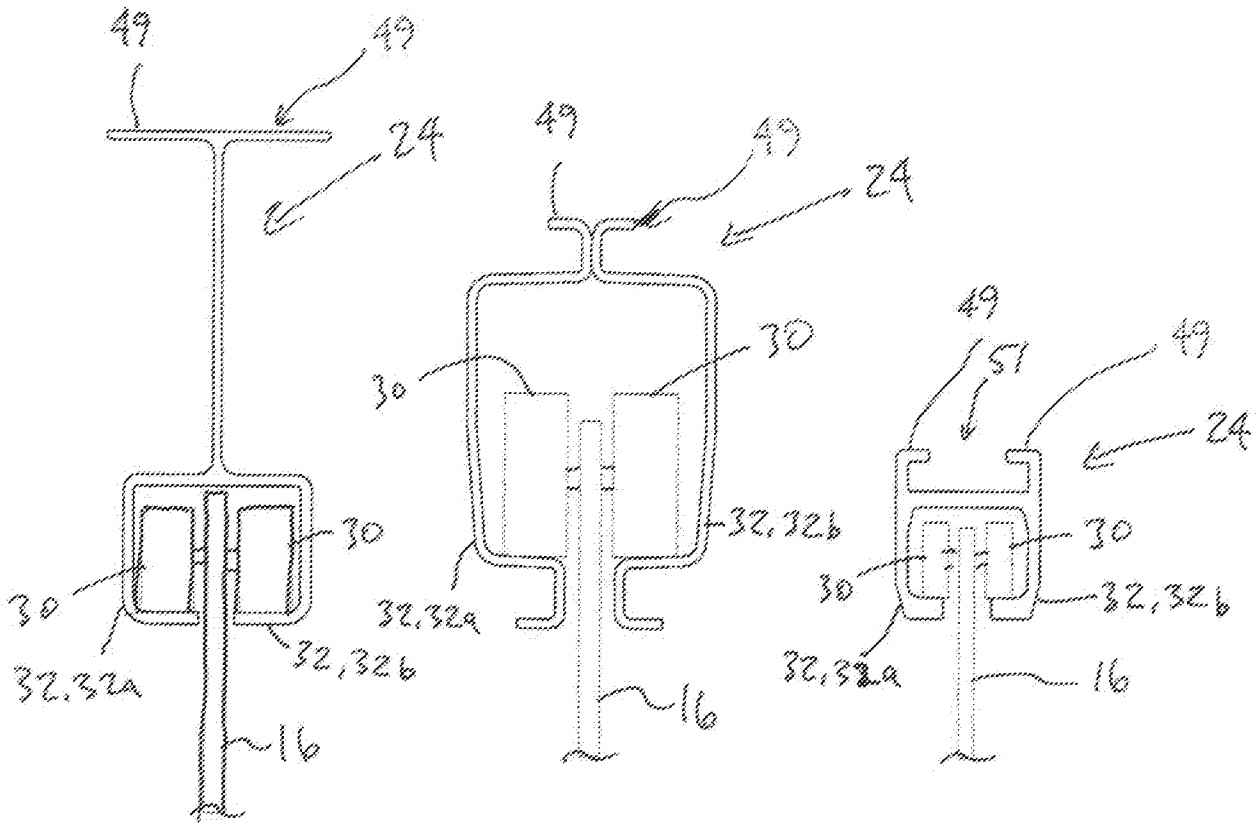
FIG. 5 is a magnified end view of another alternative bridge rail that could alternatively be part of the bridge rail shown in FIG. 2.
FIG. 6 is a magnified end view of another alternative bridge rail that could alternatively be part of the bridge rail shown in FIG. 2.
FIG. 7 is a magnified end view of another alternative bridge rail that could alternatively be part of the bridge rail shown in FIG. 2.

The bridge rail 24 in FIG. 2 has a pair of track flanges 32 (shown individually at 32*a* and 32*b*), which define a track 34 on which the trolley wheels 30 travel. The flanges 32 may be oriented towards each other so that the track 34 is an enclosed track as shown in FIG. 3. Alternatively, the flanges 32 may be oriented away from each other in which case the track 34 is an open track, as shown in FIG. 4. Other suitable shapes for the bridge rail 24 are shown in FIGS. 5, 6 and 7.

The bridge rail 24 may be made from any suitable material, such as aluminum. It will be understood that, throughout this disclosure, the term aluminum is intended to encompass both pure aluminum and aluminum alloys. By manufacturing the bridge rail 24 out of aluminum the bridge rail 24 is lighter than if it were manufactured from a material such as steel.

Referring to FIG. 2, the bridge 14 further includes a first bridge reinforcement member 36, and two second bridge reinforcement members 38 (shown individually at 38*a* and 38*b*). The first and second bridge reinforcement members 36 and 38 may be made from any suitable material, such as aluminum tubing. The tubing may be round, which provides increased resistance to buckling (which is advantageous for the members that are in compression—in this case, the second members 38).

Figure 8:
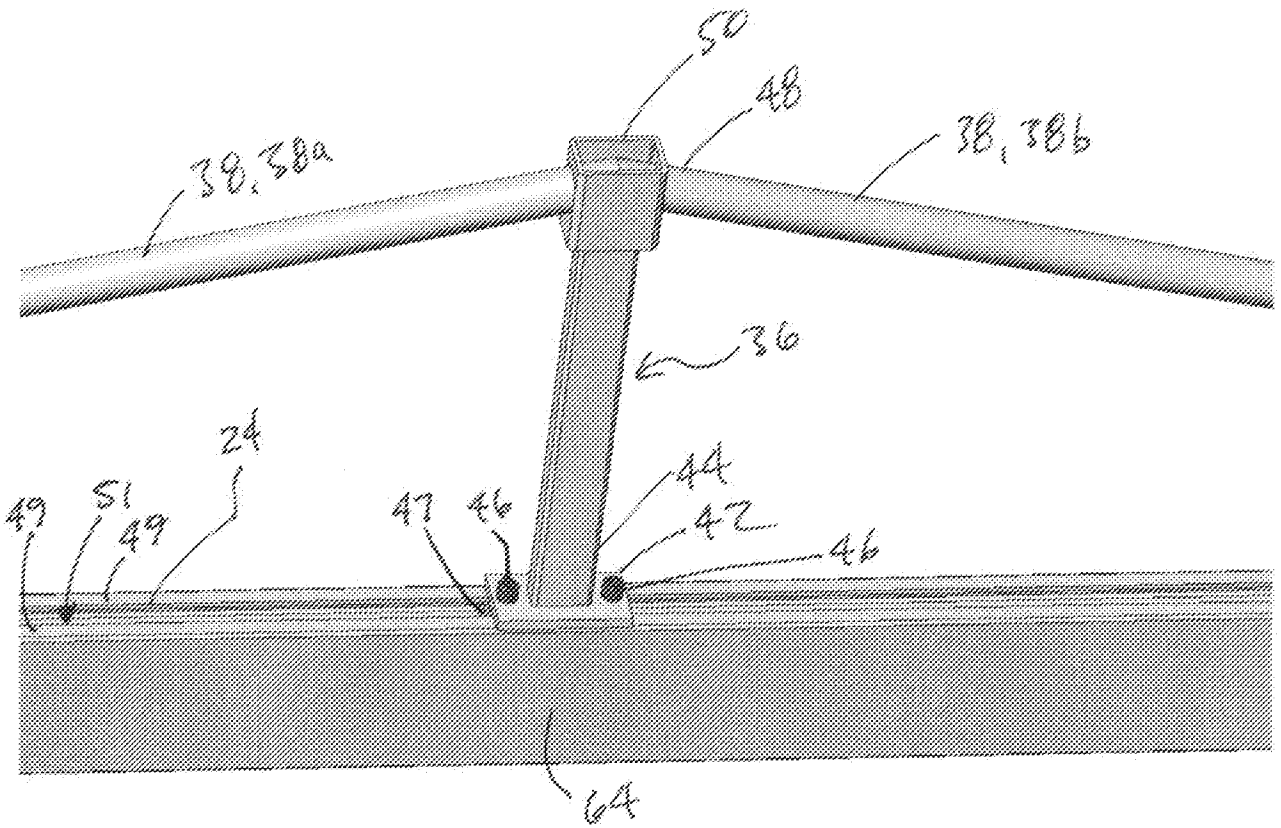
FIG. 8 is a magnified perspective view of the mounting of a first reinforcement member to the bridge rail shown in FIG. 2.
Figure 6:
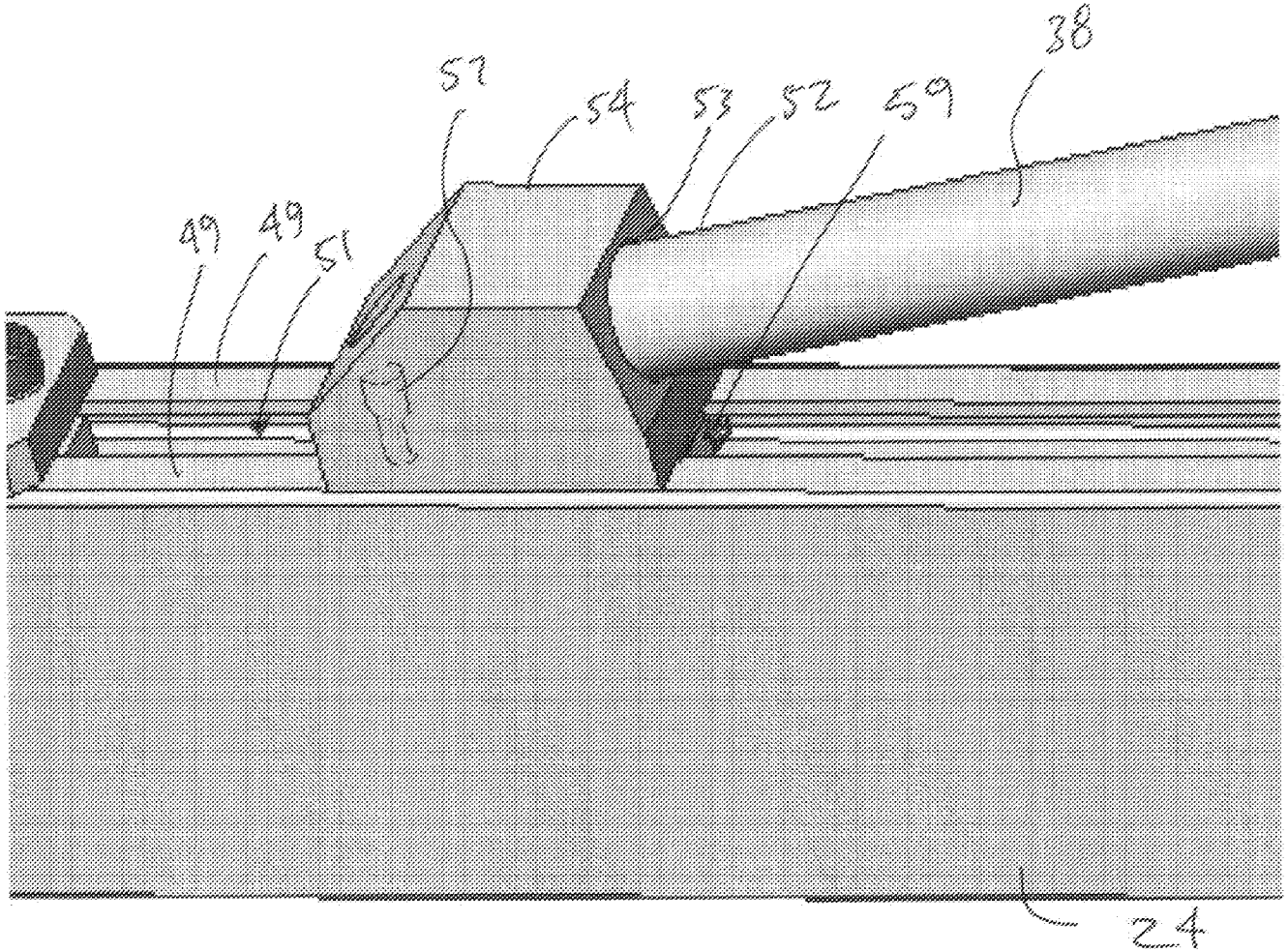

The first bridge reinforcement member 36 may be mounted to the bridge rail 24 in any suitable way, such as by a mechanical connection. For example, as shown in FIG. 8, the first bridge reinforcement member 36 may be provided with a support flange 42 at its lower end shown at 44. Mechanical fasteners 46 (eg. bolts) may be provided that pass through the support flange 42, through a slot 51 between a pair of flanges 49 on the bridge rail 24, and into a first member clamping plate 47. When the fasteners 46 are tightened the two elements 42 and 47 together clamp the flanges 49 on the bridge rail 24 thereby fixing the first bridge reinforcement member 36 in position on the bridge rail 24. The second flanges 49 may be referred to as reinforcement support flanges as they support the reinforcement structure 35.

Each second bridge reinforcement member 38 has a first end 48 that may be mechanically connected to the top end (shown at 50) of the first bridge reinforcement member 36. For example, as shown in FIG. 8, the first ends 48 of the second reinforcement members 36 may pass through apertures 55 in the top end 50 of the first member 36, and may abut each other so that the first end 48 of each member 36 braces the first end 48 of the other member 36. Each aperture 55 may be referred to as a first member receiving aperture. It is alternatively possible instead to make each aperture 55 as a blind aperture that has an end wall that acts to brace the first end 48 of each second member 38.

Figure 9A:
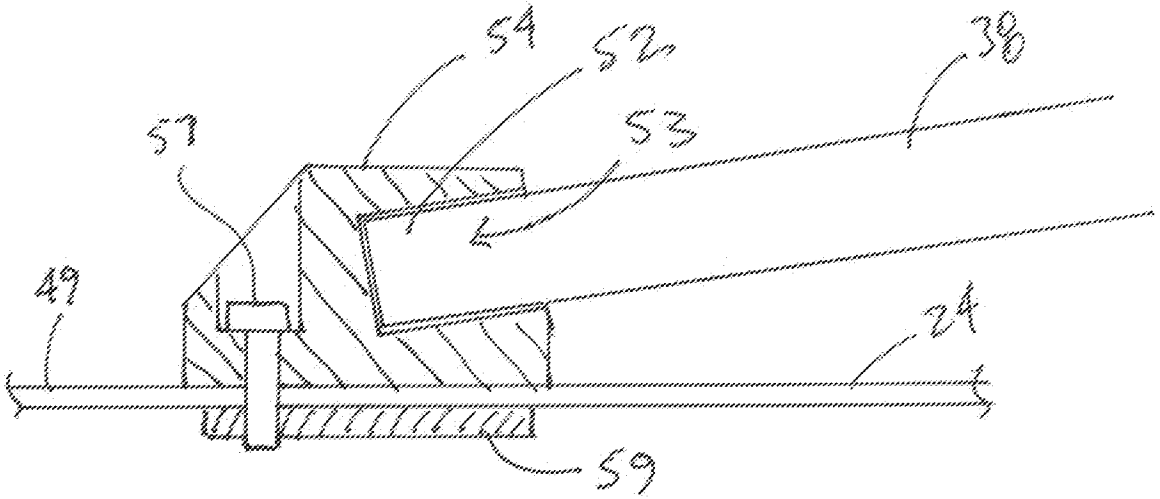
FIG. 9*a* is a magnified sectional view of a bracket shown receiving the second reinforcement member in FIG. 9.

Each second bridge reinforcement member 38 has a second end 52 (FIGS. 9 and 9*a*) that may be inserted into a receiving aperture 53 in a bracket 54 on the upper portion of the bridge rail 24. The brackets 54 may be joined to the bridge rail 24 in any suitable way. For example, each bracket 54 may have one or more bracket mechanical fasteners 57 that pass through the bracket 54, through the slot 51 between the reinforcement support flanges 49 and into a bracket clamping plate 59. Tightening of the bracket mechanical fasteners 57 causes the bracket 54 and the bracket clamping plate 59 to clamp the flanges 49 on the bridge rail 24 to hold the bracket 54 in place during use. In FIG. 9*a*, only one of the upper flanges 49 is shown for simplicity.

The receiving aperture 53 may be a blind aperture with an end wall to support the second end 52 of the second bridge reinforcement member 38. The receiving aperture 53 may be referred to as a bracket receiving aperture 53.

During use with a chain type hoist on the trolley 16, the first member 36 is in tension and the second members 38 are in compression.

It will be noted that, because the second members 38 are in compression when in use, they do not require further fastening to the brackets 54 and to the first member 36. Accordingly, they can be relatively simple to mount to the first member 36 and to the bridge rail 24.

Referring to FIG. 2, the position of the first bridge reinforcement member 36 may be generally centered along the length of the bridge rail 24. The positions of the second ends 52 of the second bridge reinforcement members 38 may be proximate the ends of the bridge rail 24 while ensuring that the brackets 54 and the reinforcement members 38 do not interfere with the rolling of the bridge 14 along the runway rails 20.

The reinforcement members 36 and 38 together form a truss that is relatively simple and inexpensive to manufacture and that is relatively simple and quick to mount to the bridge rail 24 and is particularly advantageous in embodiments wherein the bridge rail 24 is made from aluminum. While mechanical joints are preferred for connecting the reinforcement members 36 and 38 to each other and to the bridge rail 24, particularly when all of these components are made from aluminum, it is nonetheless contemplated that these components could alternatively be welded together.

In general, welding to an aluminum bridge rail can be difficult to achieve without weakening the parent material that makes up the bridge rail. Use of mechanical fasteners instead to join reinforcement members to a bridge rail can be relatively time consuming however. Some proposed prior art reinforcement structures do not lend themselves to be joined to an aluminum bridge rail, since they entail joining to the bridge rail at many points, which would involve either many welds, which would weaken the bridge rail, or many mechanical fasteners, which would make the bridge rail prohibitively time consuming to manufacture.

The reinforcement structure 35 provides the greatest increase in bending strength to the bridge rail 24 at the longitudinal center of the bridge rail 24, shown at 64, which is also where the lifting device 18 exerts the greatest bending moments on the bridge rail 24. The amount of bending strength the reinforcement structure 35 provided to the bridge rail 24 decreases from the longitudinal center 64 toward the outer ends (which are shown at 65*a* and 65*b*). It will be noted that the increased resistance to bending provided by the reinforcement members 36 and 38 generally matches the bending moment profile of bending moments exerted by the lifting device 18 on the bridge rail 24 at different points along the bridge rail 24 while holding a load. As a result, the reinforcement members 36 and 38 are efficient in the sense that they provide the most strengthening to the portion of the bridge rail 24 that incurs the highest bending moments (ie. the middle of the bridge rail 24).

By providing the reinforcement members 36 and 38, the bridge rail 24 can be made lighter than would otherwise be required if it consisted only of the bridge rail 24, for holding a selected size of load. This reduces the overall amount of weight that an operator must push or pull in embodiments wherein bridge drive motors are not provided. This is also advantageous in embodiments that do include drive motors for the bridge since the bridge drive motor (or motors) have less work to do to move the lighter bridge along the runway rails.

Another advantage to this configuration is that the bridge 14 has less momentum associated with it, and so the operator has a greater degree of control over stopping the bridge 14 after rolling the bridge 14 to a selected point along the runway rails 20. This is particularly relevant for bridges 14 that have relatively long spans, which are necessarily heavier and which have larger bending moments associated therewith resulting from the greater distances between their points of support on the runway rails and the load.

Figure 10:
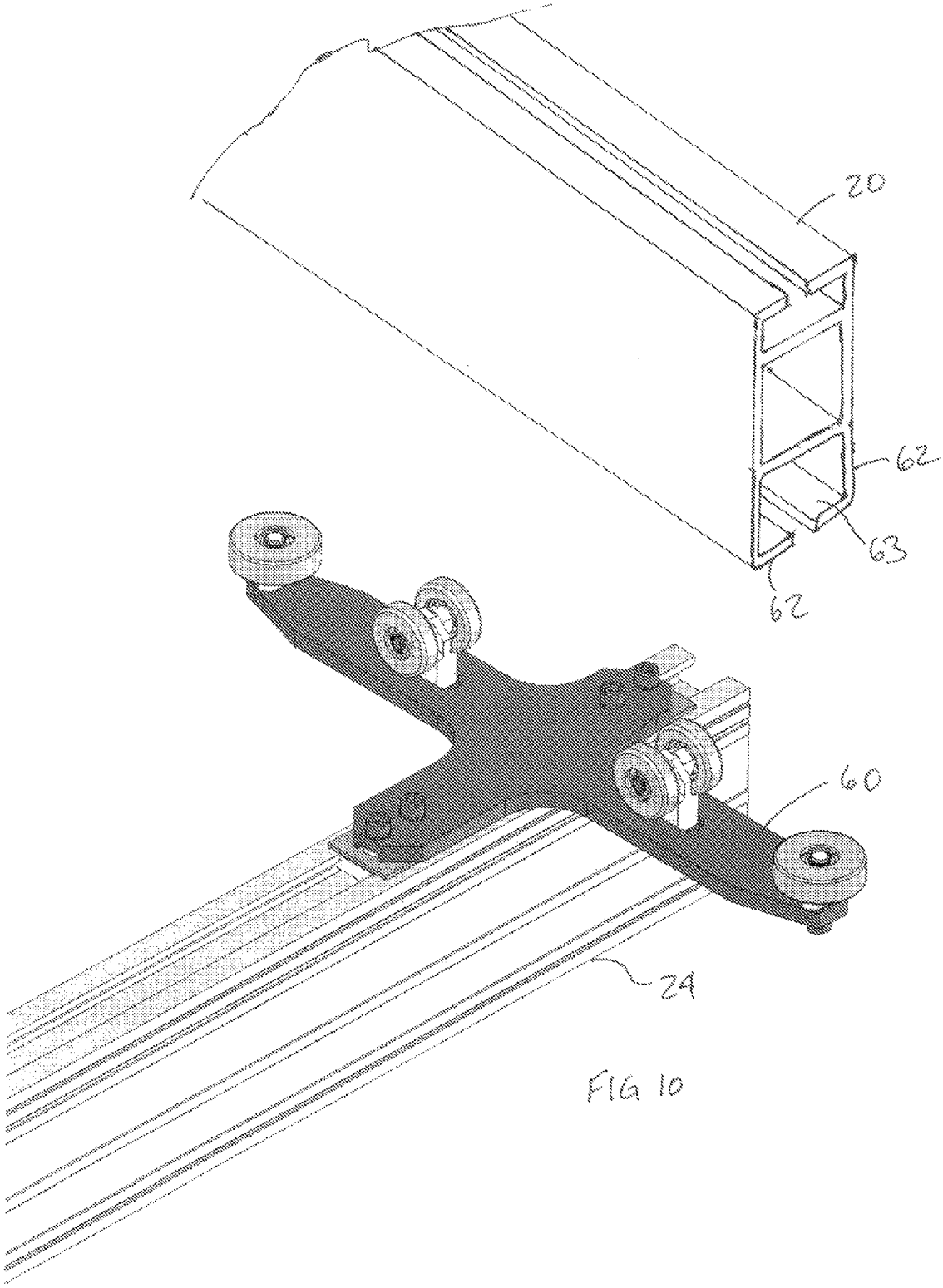
FIG. 10 is a magnified perspective view of an end of the bridge rail shown in FIG. 2 and an end of a runway rail shown in FIG. 2.

Referring to FIG. 10, the bridge 14 further includes a rolling structure 60 mounted at each end of the bridge rail 24 by clamping the upper flanges 49, in similar fashion to the clamping of the flanges 49 by the first member 36 and by the brackets 54. The rolling structure 60 rolls along flanges shown at 62 on the runway rails 20.

The trolley 16 may be made substantially from aluminum. Other materials may also be used in addition to or instead of aluminum.

The lifting device 18 may be a hoist or may be some other suitable type of lifting device.

Other configurations of the reinforcement structure 35 are possible, which provide increased bending strength to the bridge rail 24, while keeping the number of mounting points between the reinforcement structure 35 and the bridge rail 24 relatively low, and while generally matching the bending moment profile exerted on the bridge rail 24 by the load being held by the lifting device 18 at different positions along the length of the bridge rail 24. In one exemplary alternative configuration, two first reinforcement members 36 may be provided, each of which is connected to a second member 38. The two members 36 may optionally share a common support flange, or may optionally have separate support flanges. The two first members 36 can be positioned proximate each other at the longitudinal center 64 of the bridge rail 24 such that the increase in bending resistance to the bridge rail 24 has roughly the same shape as it did with one centrally positioned first member 36. Alternatively, the two first members 36 can be spaced from each other, and optionally a third reinforcement member can extend between them (eg. generally horizontally between their upper ends). In another alternative, a single centrally positioned first member 36 may be provided, and smaller third members may be provided partway along the length of each second member 38 extending vertically between the second member and the bridge rail 24 to increase the buckling resistance of the second member 38.

Referring to FIG. 2, the runway rails 20 may be made similarly to the bridge rail 24 in that they each include flanges 62 that define a track 63. Each runway rail 20 may further be strengthened by a reinforcement structure 72 which increases the bending resistance of the runway rail 20 so as to resist bending forces from the bridge 14. In the exemplary embodiment shown in FIG. 2, the reinforcement structure 72 comprises a first runway reinforcement member 78 which extends upwardly from the longitudinal center of the runway rail 20, and two second reinforcement members 80 which extend between the upper end of the first member 78 and the runway rail 20 proximate the ends 76*a* and 76*b*. By strengthening the bending resistance of the runway rail 20 in this way, the runway rail 20 itself may be made smaller than it would need to be if the reinforcement structure 72 were omitted. As a result, the overall weight and cost of the runway rail 20 may be reduced relative to a runway rail that did not have a reinforcement structure thereon. It will be noted, however, that reducing the weight of the runway rail, while advantageous, does not facilitate the movement of a lifted load to a destination point, since the runway rails 20 remain fixed in place throughout any operation with the overhead crane. The runway rails 20 may be made from any suitable material, such as steel, or aluminum.

Figure 1:
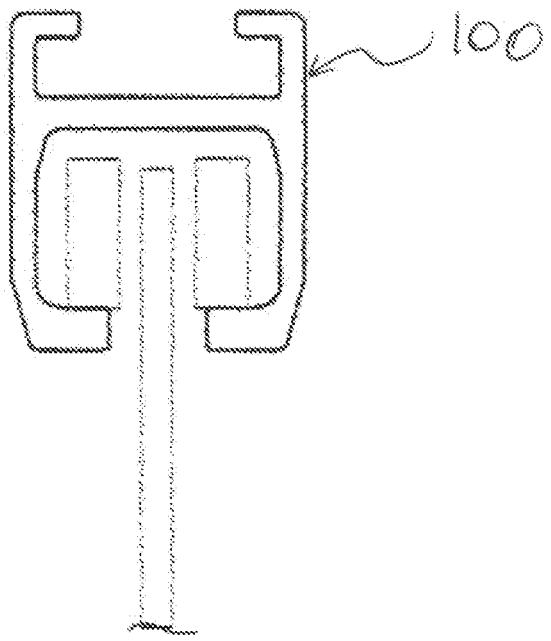
FIG 1 (PRIOR ART)
FIG. 1 is an end view of a bridge rail used in a crane in accordance with the prior art.
Figure 12:
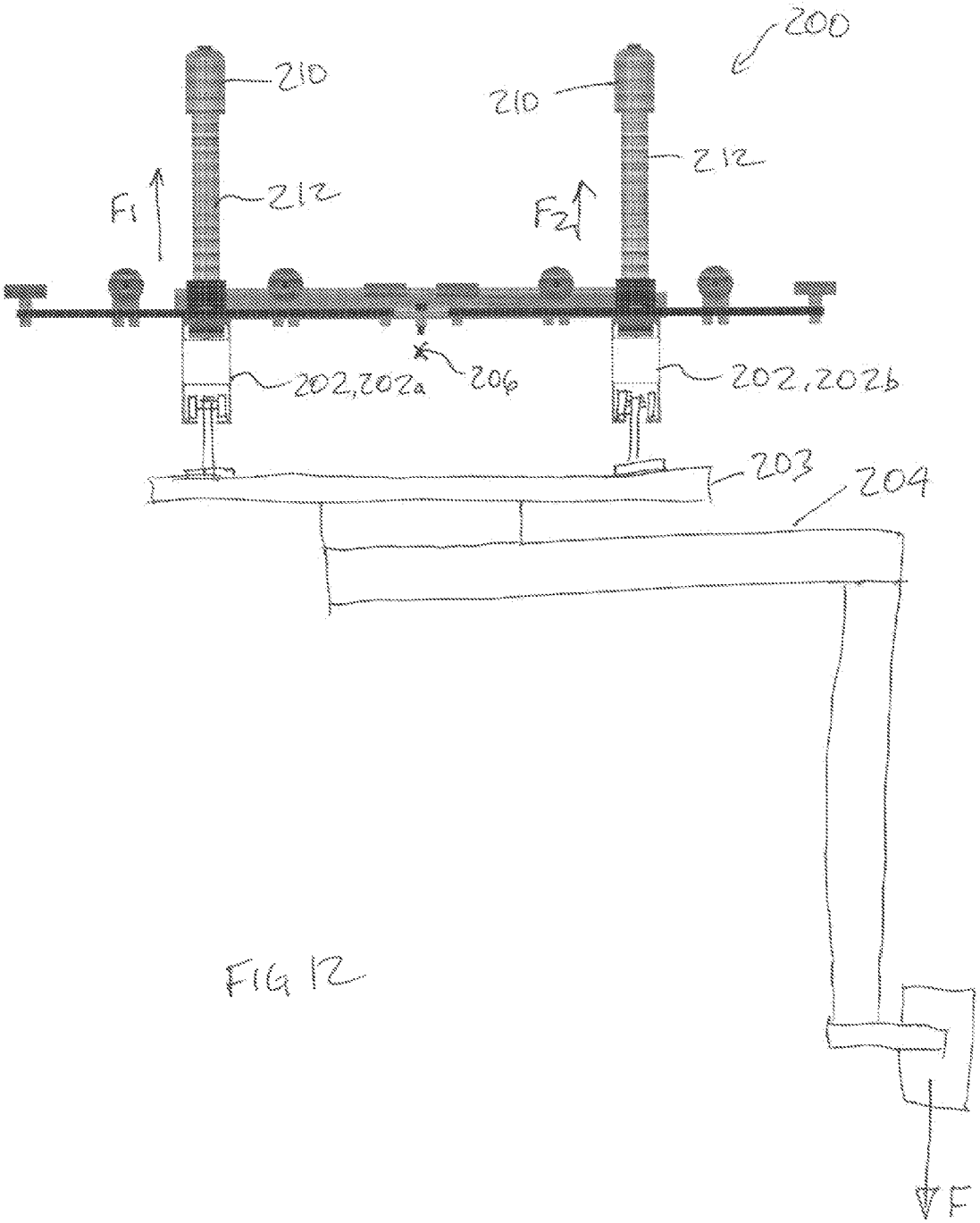
FIG. 12 is a magnified end view of the double rail bridge shown in FIG. 11 supporting a trolley and a manipulator.

Reference is made to FIG. 11, which shows a double rail bridge 200 which can be used as part of the overhead crane 10 instead of the single rail bridge 14 (FIG. 1). The double rail bridge 200 has first and second bridge rails 202 (shown individually at 202*a* and 202*b*), which together support a trolley 203 that may hold a lifting device such as a manipulator 204. During use of the manipulator 204 forces may be applied to the bridge 200 that are laterally offset from the longitudinal centerline of the bridge 200 (which is shown at 206 as a point in FIG. 12). An exemplary offset force is shown at F. The force F generate reaction forces F1 and F2 on the bridge 200. As shown the force F generates an upwardly directed force F1 on the bridge rail 202*a* and a downwardly directed force F2 on the bridge rail 202*b*. Each bridge rail 202 has a reinforcement structure 208 thereon that includes a first bridge reinforcement member 210 and two second reinforcement members 212. Brackets 214 may be provided to connect the second ends of the second reinforcement members 212 to the bridge rail 202.

It will be noted that, for the bridge rail 202*a*, the first reinforcement member 210 is under compression and the two second reinforcement members 212 are under tension. Conversely, the first reinforcement member 210 on the second bridge rail 202*b* is under tension and the second reinforcement members 212 on the second bridge rail 202*b* are under compression, in similar manner to the single rail bridge 14 shown in FIG. 2. It will be understood that in situations during use of the crane 200, the manipulator 204 may be positioned on the other side of the centerline 206 and so the tension and compression in the members of the reinforcement structures 208 on the two bridge rails 202*a* and 202*b* will be reversed.

In order to prevent the second reinforcement members 212 from withdrawing from the first reinforcement member 210, the second reinforcement members 212 have lateral extending first end retaining pins 215 that pass through their first ends, shown at 216. The pins 215 engage an inboard face of a wall 218 on the first reinforcement member 210 to prevent the withdrawal of the second reinforcement member 212 therefrom. The pins 215 may be in the form of threaded fasteners (e.g. a bolt and nut).

Figure 13:
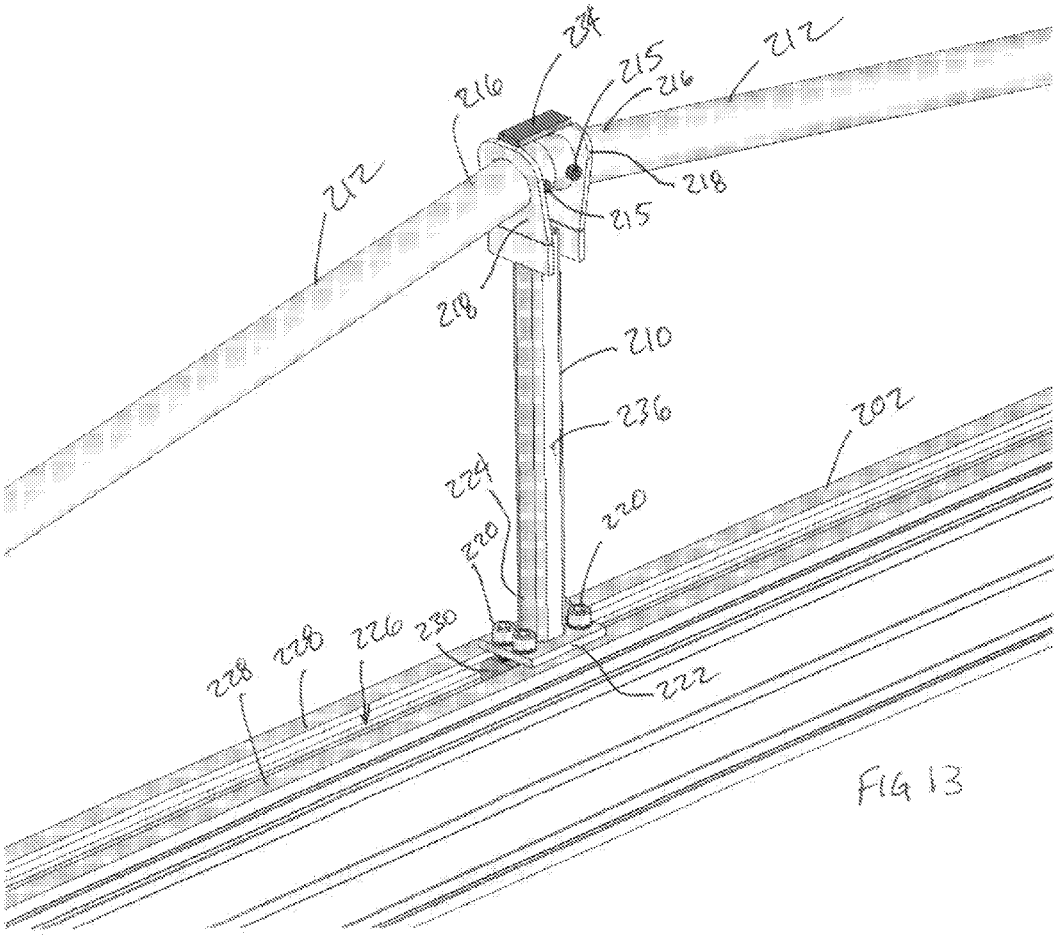
FIG. 13 is a magnified perspective view of a portion of one of the bridge rails shown in FIG. 11.

Referring to FIG. 13, the first reinforcement member 210 may be mounted to the bridge rail 202 in any suitable way, such as by use of one or more threaded fasteners 220 that pass through a support flange 222 at the bottom end 224 of the first reinforcement member 210. The threaded fasteners 220 pass through a slot 226 between first and second reinforcement support flanges 228 on the bridge rail 202, and pass into a threaded aperture in a clamping plate 230 so that the support flange 222 and the clamping plate 230 together clamp the flanges 228 on the bridge rail 202.

Referring to FIG. 13 still, the walls 218 of the first reinforcement member 210 each have a first member receiving aperture 232 there in for receiving the first ends 216 of the second reinforcement members 212. The walls 218 may be connected to each other by a bar 234 that is welded (or is otherwise connected) across their respective tops. The walls 218 may each be connected to the main body shown at 236 of the first reinforcement member 210 by welds or by any other suitable type of connection. It can be seen that the space between walls 218 is open in the lateral direction so as to permit easy access for installing the first end retaining pins 215 and for visually ensuring that the first ends 216 are positioned suitably to brace each other.

Figure 14:
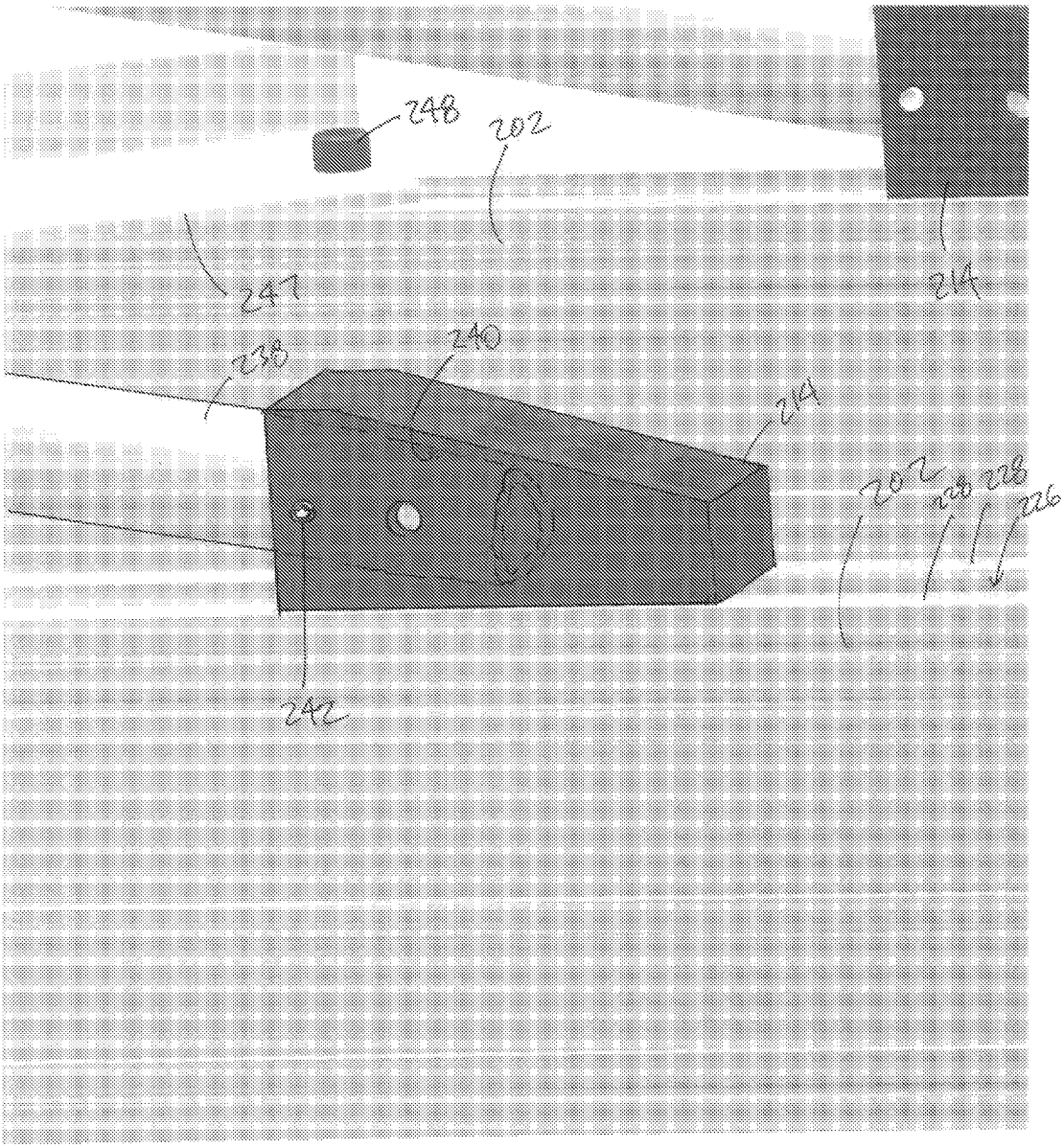
FIG. 14 is a magnified perspective view showing the mounting of one of the second reinforcement members shown in FIG. 11 to one of the bridge rails shown in FIG. 11.

Referring to FIG. 14, each second reinforcement member 212 has a second end 238 that extends into a bracket receiving aperture 240 in one of the brackets 214. A laterally extending second end retaining pin 242 extends laterally through the bracket 214 and through the second end 238 of the second reinforcement member 212. The pin 242 may be any suitable type of pin, such as a spring pin.

Figure 14A:
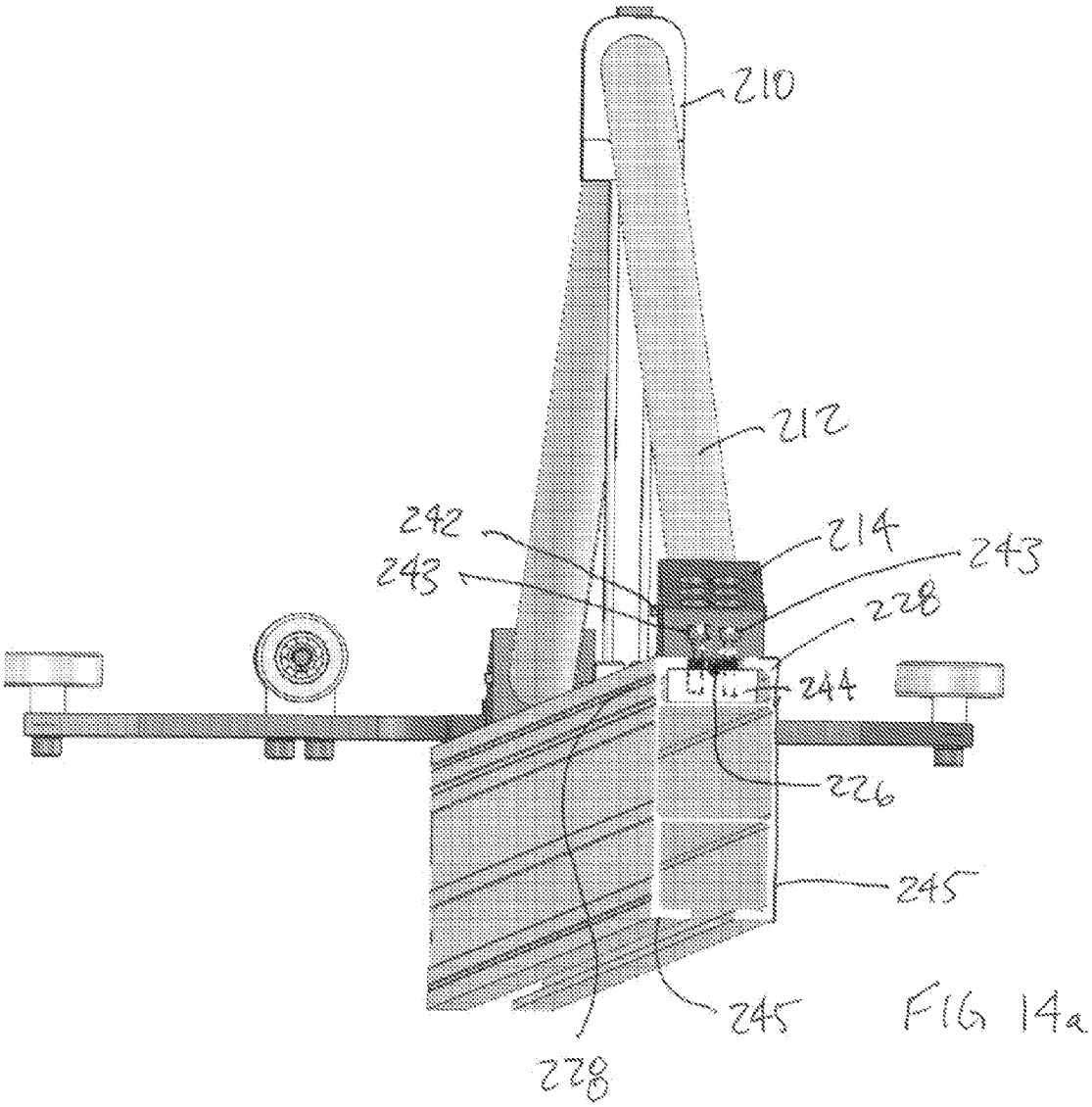
FIG. 14*a* is a magnified perspective view further showing the mounting of the second reinforcement member shown in FIG. 14 to a bracket, which is mounted to the bridge rail shown in FIG. 14.

Referring to FIG. 14*a*, each bracket 214 may connect to the bridge rail 202 by means of mechanical fasteners 243 which pass through the bracket 14, through the slot 226 between the upper flanges 228 on the bridge rail 202, and into a threaded aperture in a clamping plate 244 so as to clamp the flanges 228.

As can be seen in FIG. 14*a*, the bridge rails 202 may each have a similar profile to the bridge rail 24. The bridge rails 202 may have any suitable profile, such as any of the profiles shown in FIGS. 3-7. The bridge rails 202 may thus have track flanges 245, which are similar to the track flanges 32 and which together define a track.

Figure 15:
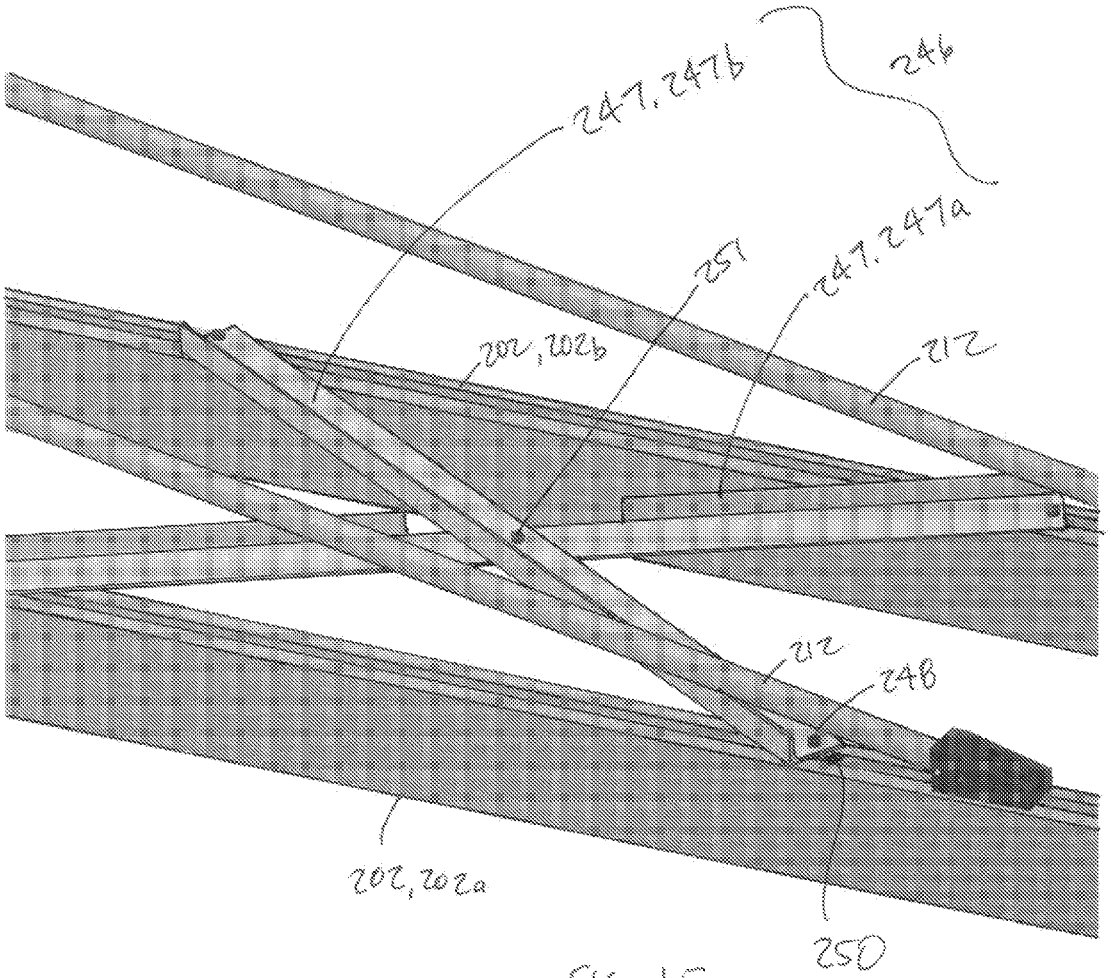
FIG. 15 is a magnified perspective view of the double rail bridge showing the connection between the first and second bridge rails.

Referring to FIGS. 11 and 15, one or more X-bracing structures 246 may be provided between the first and second bridge rails 202*a* and 202*b* so as to structural connect them. Each X-bracing structure 246 may be made up of first and second cross members 247, shown individually at 247*a* and 247*b*. Each cross member 246 may be connected at its ends to the bridge rails 202 by means of threaded fasteners and clamping plates at shown at 248 and 250 in FIG. 15. The cross members 247*a* and 247*b* are also connected to each other at their respective middles by pin connection 251.

Referring to FIG. 11, each of the bridge rails 202 has a rolling structure 252 at each end that may be similar to the rolling structure 60 (FIG. 10).

It will be noted that the reinforcement structures 35 and 208 can easily be retrofitted to existing bridge rails 24, 202 in an existing overhead crane 10, 200, particularly where the overhead crane has upper flanges that can be used as reinforcement support flanges. As a result, the bridge rails can be strengthened significantly so as to be capable of supporting increased loads. It will further be noted that the reinforcement can be provided by the structure 35, 208 without the need for welding elements to the rails 24, 202, without drilling through the rails 24, 202 and without requiring an inordinate number of fasteners.

It is optionally possible to provide the retaining pins 215 and 242 on a single rail bridge, such as the bridge 14, for use in situations where the single rail bridge 14 will be subjected to upward forces from the lifting member.

While the above description constitutes a plurality of embodiments of the present invention, it will be appreciated that the present invention is susceptible to further modification and change without departing from the fair meaning of the accompanying claims.

The invention claimed is:

1. An overhead crane, comprising:

first and second runway rails that extend parallel to a generally horizontal runway axis;

a bridge that extends along a bridge axis that is generally horizontal and perpendicular to the runway axis and that is movable on the runway rails along the runway axis, wherein the bridge includes a bridge rail having first and second ends and rolling structures at the first and second ends which are rollably supported on the first and second runway rails;

a trolley having a plurality of trolley wheels thereon permitting movement of the trolley along the bridge rail; and a lifting device for holding a load, wherein the lifting device is supported by the trolley, wherein the bridge further includes a single first bridge reinforcement member supporting the bridge rail and extending upwardly substantially from the longitudinal center of the bridge rail, the first bridge reinforcement member having a lower end mechanically connected to the bridge rail, and an upper end, the first bridge reinforcement member loaded under tension, a single pair of second bridge reinforcement members also supporting the bridge rail and extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail.

2. The overhead crane as claimed in claim 1, wherein the bridge rail comprises aluminum.

3. The overhead crane as claimed in claim 1, wherein the bridge rail is manually rollable along the runway rails by means of bridge wheels.

4. The overhead crane as claimed in claim 1, wherein for each runway rail, the runway includes:

a first runway reinforcement member extending upwardly from the runway rail, the first runway reinforcement member having a lower end connected to the runway rail, and an upper end; and two second runway reinforcement member extending between the upper end of the first runway reinforcement member and the runway rail proximate the first and second outer ends.

5. The overhead crane as claimed in claim 1, wherein the first bridge reinforcement member has first and second opposed first member receiving apertures at the upper end, and wherein the bridge rail further includes first and second brackets positioned respectively at the first and second outer ends of the bridge rail, each bracket having a bracket receiving aperture that generally faces one of the first member receiving apertures, and wherein each second bridge reinforcement member has a first end that extends into one of the first member receiving apertures and a second end that extends into the bracket receiving aperture on one of the brackets.

6. The overhead crane as claimed in claim 5, wherein the first ends of the two second bridge reinforcement members abut each other.

7. The overhead crane as claimed in claim 6, wherein the first bridge reinforcement member and the brackets are mounted to the bridge via mechanical fasteners.

8. The overhead crane as claimed in claim 7, wherein the bridge rail includes a pair of track flanges which form a track for a trolley, and wherein the bridge rail further includes a pair of reinforcement support flanges, and wherein at least one fastener passes through each of the first bridge reinforcement member and the brackets and into an associated clamping plate to clamp the reinforcement support flanges.

9. The overhead crane as claimed in claim 8, wherein the at least one fastener comprises a threaded fastener that removably connects to the respective clamping plate.

10. The overhead crane as claimed in claim 5, wherein the first end of each second bridge reinforcement member is retained within the first end receiving aperture by a first end retaining pin, and the second end of each second bridge reinforcement member is retained within the second end receiving aperture by a second end retaining pin.

11. An overhead crane, comprising:

first and second runway rails that extend parallel to a generally horizontal runway axis;

a bridge that extends along a bridge axis that is generally horizontal and perpendicular to the runway axis and that is movable on the runway rails along the runway axis, wherein the bridge includes first and second bridge rail that are connected to each other and that are generally parallel, wherein each bridge rail has first and second ends and rolling structures at the first and second ends which are rollably supported on the first and second runway rails;

a trolley that is rollably supported on the first and second bridge rails; and a lifting device for holding a load, wherein the lifting device is supported by the trolley and is capable of lifting loads in such a way as to generate downward forces that are offset laterally from the bridge axis, wherein, for each bridge rail, the bridge further includes a single first bridge reinforcement member supporting the bridge rail and extending substantially upwardly from the longitudinal center of the bridge rail, the first bridge reinforcement member having a lower end mechanically connected to the bridge rail, and an upper end, the first bridge reinforcement member loaded under tension, a single pair of second bridge reinforcement members also supporting the bridge rail and extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail, wherein the first bridge reinforcement member has first and second opposed first member receiving apertures at the upper end, and wherein the bridge rail further includes first and second brackets positioned respectively at the first and second outer ends of the bridge rail, each bracket having a bracket receiving aperture that generally faces one of the first member receiving apertures, and wherein each second bridge reinforcement member has a first end that extends into one of the first member receiving apertures and a second end that extends into the bracket receiving aperture on one of the brackets, and wherein the first end of each second bridge reinforcement member is retained within the first end receiving aperture by a first end retaining pin, and the second end of each second bridge reinforcement member is retained within the second end receiving aperture by a second end retaining pin.

12. A retrofit kit for strengthening an overhead crane, wherein the overhead crane includes first and second runway rails that extend parallel to a generally horizontal runway axis, a bridge that extends along a bridge axis that is generally horizontal and perpendicular to the runway axis and that is movable on the runway rails along the runway axis, wherein the bridge includes a bridge rail having first and second ends and rolling structures at the first and second ends which are rollably supported on the first and second runway rails, a trolley having a plurality of trolley wheels thereon permitting movement of the trolley along the bridge rail, and a lifting device for holding a load, wherein the lifting device is supported by the trolley, wherein the bridge rail includes a pair of track flanges which form a track for a trolley and wherein the bridge rail further includes a second pair of flanges, wherein the retrofit kit includes:

a single first bridge reinforcement member supporting the bridge rail and extending upwardly substantially from the longitudinal center of the bridge rail, the first bridge reinforcement member having a lower end mechanically connected to the bridge rail, and an upper end, the first bridge reinforcement member loaded under tension, a single pair of second bridge reinforcement members also supporting the bridge rail and extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail, wherein the first bridge reinforcement member is the only first bridge reinforcement member on the bridge rail and wherein the two second bridge reinforcement members are the only two second bridge reinforcement members on the bridge rail, and wherein at least one fastener passes through each of the first bridge reinforcement member and the brackets and into an associated clamping plate to clamp the second flanges.

13. The retrofit kit as claimed in claim 12, wherein the at least one fastener is a threaded fastener that removably connects to the respective clamping plate.

14. The overhead crane as claimed in claim 1, wherein the second bridge reinforcement members are unfastened with respect to the first bridge reinforcement member.

15. The overhead crane as claimed in claim 11, wherein the second bridge reinforcement members are unfastened with respect to the first bridge reinforcement member.

16. The retrofit kit as claimed in claim 12, wherein the second bridge reinforcement members are unfastened with respect to the first bridge reinforcement member.

* * * * *